US005470108A

United States Patent [19]

Goode et al.

[11] Patent Number: 5,470,108

[45] Date of Patent: Nov. 28, 1995

[54] SKI POLE GRIP ASSEMBLY

[76] Inventors: David P. Goode, 1997 Long Lake Shore Dr., Bloomfield Hills, Mich. 48302; Frank E. Vogel, 136 Walnut, Apt. 1, Rochester, Mich. 48307

[21] Appl. No.: 956,802

[22] Filed: Oct. 5, 1992

[51] Int. Cl.[6] ..... A63C 11/22

[52] U.S. Cl. ..... 280/823; 16/111 R; 135/75; 280/821; 280/822

[58] Field of Search ..... 280/819, 821, 280/823, 822; 135/65, 75; 16/111 R

[56] References Cited

U.S. PATENT DOCUMENTS

| | | | |
|---|---|---|---|
| 2,533,733 | 12/1950 | Jensen | 280/11.37 |
| 3,170,703 | 2/1965 | Marchand | 280/822 |
| 3,179,435 | 4/1965 | Miller | 280/11.37 |
| 3,218,089 | 11/1965 | Marchand | 280/11.37 |
| 3,232,632 | 2/1966 | Lewis | 280/11.37 |
| 3,367,673 | 2/1968 | Covini | 280/11.37 |
| 3,540,741 | 11/1970 | Pierce | 280/11.37 |
| 3,565,451 | 2/1971 | Giambazi | 280/11.37 |
| 3,567,237 | 3/1971 | Miller | 280/11.13 |
| 3,746,356 | 7/1973 | Shipstad | 280/11.37 |
| 4,337,963 | 7/1982 | Stevenson | 280/87.04 |
| 4,456,285 | 6/1984 | Weber-Henning | 280/823 |
| 4,653,121 | 3/1987 | Kassal et al. | 2/160 |
| 4,712,304 | 12/1987 | Sanelli | 30/343 |
| 4,739,536 | 4/1988 | Bandera et al. | 16/111 R |
| 4,877,050 | 10/1989 | Harris | 16/111 R |
| 4,934,024 | 6/1990 | Sexton | 16/111 |
| 4,949,457 | 8/1990 | Burout | 30/35 |
| 5,092,629 | 3/1992 | Bagneres et al. | 280/821 |
| 5,110,154 | 5/1992 | Street | 280/822 |
| 5,114,186 | 5/1992 | Sugiyama | 280/821 |
| 5,123,674 | 6/1992 | Bagneres et al. | 280/821 |
| 5,139,283 | 8/1992 | Dow et al. | 280/819 |
| 5,290,063 | 3/1994 | Lenhart | 280/821 |

FOREIGN PATENT DOCUMENTS

| | | | |
|---|---|---|---|
| 2378534 | 9/1978 | France . | |
| 2596998 | 10/1987 | France | 280/819 |
| 2609639 | 7/1988 | France | 280/821 |
| 2229116 | 1/1974 | Germany . | |
| 2613580 | 10/1977 | Germany . | |
| 8300930 | 6/1983 | Germany . | |
| 553972 | 6/1978 | Japan . | |
| 5876243 | 10/1981 | Japan . | |
| 1123562 | 8/1989 | Japan . | |
| 61118 | 6/1941 | Norway | 280/823 |
| 62409 | 6/1941 | Norway | 280/823 |
| 2023506 | 3/1980 | United Kingdom . | |
| 2184012 | 6/1987 | United Kingdom . | |
| 2209495 | 5/1989 | United Kingdom . | |

*Primary Examiner*—Eric Culbreth
*Attorney, Agent, or Firm*—Krass & Young

[57] ABSTRACT

A ski pole assembly and a ski pole and ski glove combination. The grip includes a central core member of a relatively hard low friction material and an outer sheath member of a relatively soft high friction material. The core member includes raised pads proximate the upper end of the grip and the sheath includes windows receiving the pads so as to expose the pad surfaces and provide low friction pivot areas proximate the upper end of the grip to facilitate the swinging movement of the pole. The core member includes a downwardly opening bore receiving the upper end of the shaft of the ski pole and allowing the shaft to be adjustably positioned in the bore to selectively vary the overall length of the ski pole. The lower end of the bore as it exits the core member is oversized with respect to the shaft diameter and the sheath includes an annular liner portion extending upwardly into the bore and having an inner diameter approximating the diameter of the shaft so that the liner tightly embraces the shaft as the shaft enters the bore. The core member includes a slit proximate the lower end of the core member and a fastener assembly extends through cross bores in the portions of the core member on opposite sides of the slit to clamp the core member to the shaft in any longitudinal positions of adjustment of the core member on the shaft.

8 Claims, 5 Drawing Sheets

FIG-1
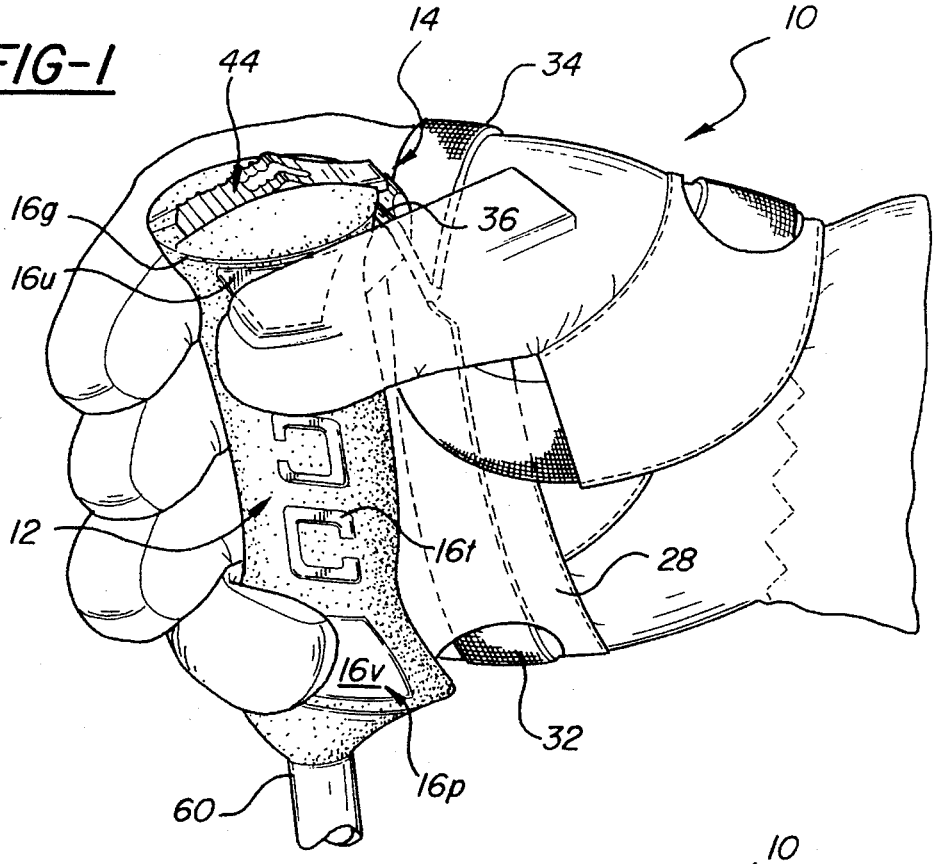
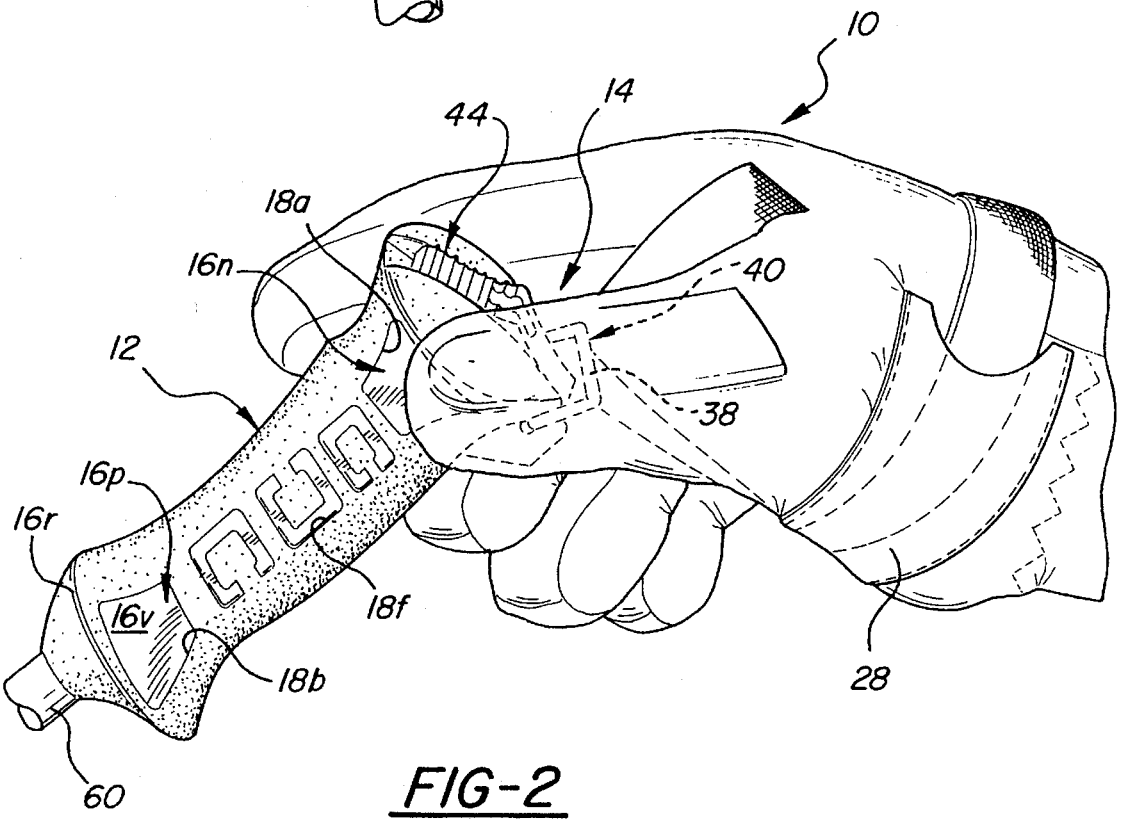
FIG-2

SKI POLE GRIP ASSEMBLY

BACKGROUND OF THE INVENTION

This invention relates to ski poles, ski gloves, and arrangements to facilitate the interaction of the ski pole and the ski glove to optimize the skiing experience.

Devices for providing auxiliary connection between a skier's hand or glove and the grip of a ski pole when the skier releases the grip are well-known. Their purpose has generally been to prevent inadvertent loss of the ski pole while skiing or during a fall, and to provide a convenient method for keeping the poles close at hand while the skier is adjusting equipment or otherwise performing some task with the hands during which it is impractical to maintain a grip on the poles. They also have served to some degree to enhance the skier's control of the poles while skiing.

One of the oldest and most common methods for providing such a connection has been to connect a circular strap to the ski pole grip which the skier loops over his wrist and hand. Another known device is the saber-type grip in which the grip itself is provided with a semi-rigid knuckle bow, eliminating the need for a strap.

Another approach has been to provide an interlocking connection between the ski pole grip and the ski glove itself, such that when the ski pole grip is released by the skier it remains attached directly to the glove. One such system is shown in U.S. Pat. No. 4,653,121 to Kassal et al in which a short, straight strap extends rearwardly from the top end of the ski pole grip to engage a mating strip on the top or back of the glove in a hook-and-loop connection. A disadvantage of this arrangement is that upward pressure on the pole tends to disengage the connection between the grip and the glove.

U.S. Pat. No. 3,232,632 to Lewis discloses a ski glove having a strap connected to the wrist portion of the glove and extending upwardly to a point near the tip of the thumb. The strap has an eyelet formed in the end which snaps on an anchor pin mounted on the top end of the ski pole grip to provide a connection between the glove and the pole. The position of the snap and anchor pin near the tip of the thumb and forefingers allows for a quick release using the ends of the fingers.

U.S. Pat. Nos. 3,170,703 and 3,218,089 to Marchand disclose a snap-type connector formed in a web between the thumb and forefinger for attachment to an anchor element mounted on the top end of the ski pole grip. A second snap-type connector is formed adjacent the first to permit the connection of two poles to the webbing, for example when riding a chairlift. Marchand also discloses an alternate arrangement in which the connectors are formed in a strap connected to the wrist of the glove and extending upward to a point adjacent the tip of the thumb, similar to the system in the above-described patent to Lewis.

I have found that while skiing, and particularly during competitive skiing, it is highly desirable to maintain the ski pole grip in a proper, natural grasping position with respect to the glove and hand when the grip is released by the skier. This eliminates time-consuming fumbling for the grip to reposition it once it has been released.

I have also found it desirable to provide a connection between the glove and the ski pole grip which is not disengaged, and is in fact strengthened, by upward pressure on the pole with respect to the glove.

Additionally, the teaching of the well-known "pole plant" technique has been superseded in many professional ski schools by the "pole touch", in which the pole is pivoted outwardly during the initiation phase of a turn, rather than planted forcefully into the snow. There is a preferred swing angle or pivot plane relative to the skier's hand, approximately bisecting the V between thumb and forefinger with the pivot point substantially at the intersection of the V. It is therefore important to ensure proper pivot action between the glove and the ski pole grip while maintaining the connection between them.

It is also important in a glove/grip connection system to transfer the forces encountered while skiing primarily to the wrist/palm area and the base thumb area. This allows greater comfort, pushing performance and reduced wear on the glove shell.

The above objects are equally advantageous in cross-country skiing, where the typical push-off method involves releasing the ski pole itself and applying the pushing force to the strap connecting the skier's wrist to the pole.

The above-described prior art glove/grip connecting systems are not capable of performing in the manner that I have found to be desirable. For example, they lack the strength to withstand the considerable upward shock of the pole relative to the glove. None of the prior art systems positions or maintains the ski pole grip in proper grasping position relative to the glove when the grip is released by a skier, their flexible nature and connection to the top end of the grip permitting the grip to drop well below the position in which it can easily be regrasped by the skier once released. Also, none of the prior art systems recognizes the need for a preferred swing angle and pivot point at the V of thumb and forefinger, all permitting relatively sloppy side-to-side, non-directional swaying of the pole and grip relative to the glove when the skier relaxes the grip for a "pole touch". Further, none of the prior art systems provides a ready and convenient means for adjusting the overall length of the ski pole assembly to accommodate skier's of varying height and none of the prior art systems provide a means of facilitating the firm grasping of the ski pole grip while allowing the pole to readily swing or pivot forwardly to perform a "pole touch."

In connection with the above I have invented a glove/grip interlock system which achieves the advantages listed above (resistance to upward pressure, maintaining the grip in proper grasping position and providing the proper pivot connection) in a simple economical manner. The interlock is generally achieved by providing mating interlock structure on the side or gripping surface of the ski pole grip and at the point of the V between the thumb and forefinger of the glove. The interlock structure allows the grip to pivot while maintaining proper grasping position. A clip is formed on the side surface of the ski pole grip to accept a lock bar mounted between the thumb and forefinger of the glove. The relative positions of the clip and the lock bar on the grip and glove maintain the ski pole grip as close as possible to the glove near the point of the V between the thumb and forefinger when the grip is released. The clip is pivotally connected to the lock bar to permit the pole to freely pivot or swing while still maintaining it in the proper grasping relation to the glove. The interlock system preferably includes interlock structure which mechanically locks to form an unbreakable connection between the ski pole grip and glove and which, once connected, requires that the user intentionally unlock the system before the glove can be released from the grip.

SUMMARY OF THE INVENTION

The present invention provides an improved grip assembly which facilitates the pivoting pole touch motion between glove and grip. According to an important feature of the invention, means are provided to define a relatively high friction surface on the grip to facilitate grasping of the grip by the user and means are provided to define a relatively low friction surface area on the grip proximate the upper end of the grip to facilitate the pivotal movement of the pole about the axis defined by the lock bar. This arrangement allows the grip to be normally firmly grasped by the user with the high friction material of the glove and the high friction material covering the grip coacting to preclude slippage of the grip relative to the glove, and yet allows the pole to swing freely outwardly, with a minimum of friction between the glove and the grip, to perform a "pole touch."

According to a further feature of the invention, the relatively low friction surface area comprises a pair of low friction surface areas on opposite sides of the grip proximate the upper end of the grip. This strategic placement of the low friction surface areas on opposite sides of the upper end of the grip maximizes the high friction surface area to facilitate normal grasping of the grip and yet provides a low friction interface between the glove and the grip about which the pole can be readily swung to perform a "pole touch."

According to a further feature of the invention, the grip member further defines a pair of low friction surface areas on opposite sides of the grip proximate the lower end of the grip. These further low friction areas further facilitate the ready detachment of the glove from the grip when it is desired to swing the pole outwardly about the axis of the lock bar.

According to a further feature of the invention, the grip comprises an inner core member formed of a hard, low friction material and including raised pads proximate the upper end of the core and an outer sheath member formed of a soft, high friction material surrounding the core member and including windows receiving the pads so that the exposed surfaces of the pads comprise the low friction surface area. This arrangement provides a simple and inexpensive means for providing the high friction surface area for normal grasping of the grip and the selective low friction surface areas to facilitate pivotal movement of the pole.

The invention further provides a ski pole grip which may be readily adjusted longitudinally with respect to the shaft of the ski pole to vary the overall length of the ski pole assembly.

According to the invention, the grip is adjustable longitudinally with respect to the shaft to vary the overall length of the ski pole assembly and the grip includes locking means which are operative to lock the grip on the shaft in any position of longitudinal adjustment of the grip on the shaft. This arrangement allows one size grip and one size shaft to provide a plurality of varying overall lengths for the ski pole assembly to thereby accommodate skiers of various sizes.

According to a further feature of the invention, the shaft is received in a blind bore in the grip opening at the bottom of the grip so that the extent of telescoping movement of the shaft up into the bore may be varied to vary the overall length of the pole assembly.

According to a further feature of the invention, the overall length of the pole assembly is varied in response to relative rotational movement between the grip and the shaft.

According to a further feature of the invention, the grip includes thread means which coact with thread means on the upper end of the shaft to vary the longitudinal adjustment of the grip on the shaft.

According to a further feature of the invention, the thread means on the grip comprises a bolt extending downwardly in the bore of the grip in spaced relation to the bore periphery, and the thread means on the pole includes a nut secured to the upper end of the pole for threaded coaction with the bolt carried by the grip.

According to a further feature of the invention, the grip locking means includes a slit in the lower end of the grip opening in the bore, in the lower end of the grip, and in one side face of the grip to define two grip portions at opposite sides of the slit, and fastener means engaging the grip portions and operative when actuated to clamp the grip portions on the shaft to lock the grip in any position of longitudinal adjustment on the shaft.

According to a further feature of the invention, the grip includes a core formed of a hard, low friction material and defining the bore and the locking means further includes a liner of soft, high friction material positioned in the lower end of the bore and coacting with the slit and with the fastener means to firmly grasp the shaft in any position of longitudinal adjustment on the shaft.

According to a further feature of the invention, the soft, high friction material extends out of the bore and substantially covers the core to form a soft, high friction surface on the core to facilitate grasping of the grip by the skier.

BRIEF DESCRIPTION OF THE DRAWINGS

FIG. 1 is a perspective view of a glove and ski pole grip assembly with interlocking means between the glove and grip and with the glove occupying a normal grasping position with respect to the ski pole grip;

FIG. 2 is a perspective view similar to FIG. 1 but showing the ski pole pivoted forwardly about an axis defined by the interlocking means to a position substantially separated from the glove;

DETAILED DESCRIPTION OF THE PREFERRED EMBODIMENT

Figure 3:
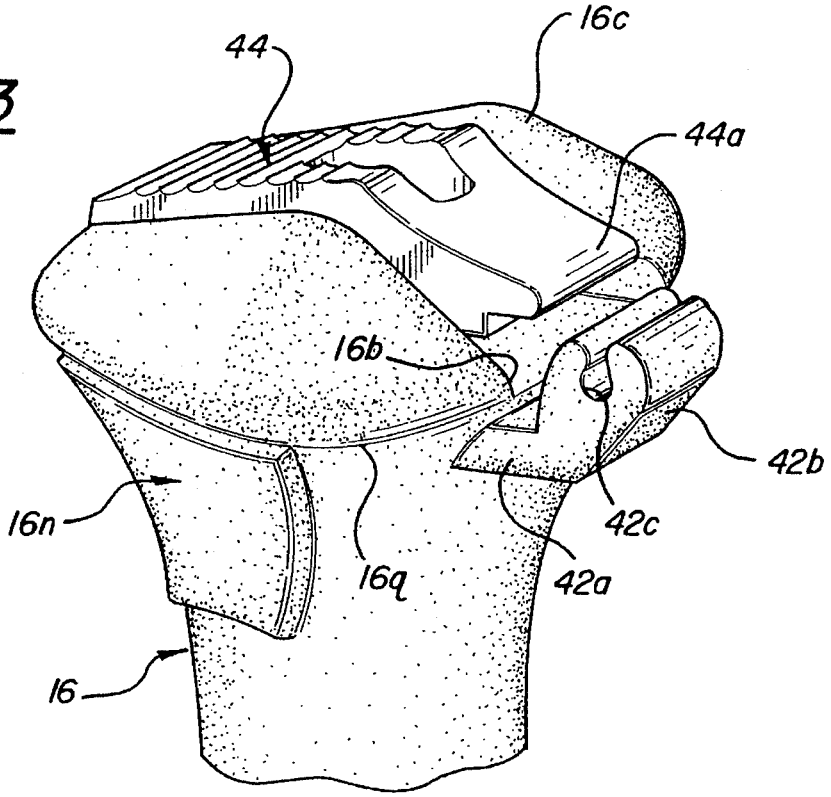
FIG. 3 is a fragmentary view of the upper end of a ski pole grip according to the invention.

A ski glove 10 and ski pole grip 12 are shown in FIGS. 1 and 2 interconnected by an interlock system 14. The glove is shown fully grasping the grip in FIG. 1 and in FIG. 2 the ski pole is pivoted forwardly, with connection between the glove and the grip being maintained by the interlock, to accomplish a "pole touch."

Grip 12 comprises an inner core member 16 formed of a hard, low friction material, such as a glass filled nylon, and an outer sheath member 18 formed of a soft, high friction material such as a thermoplastic rubber. Inner core 16 is formed in an injection molding process in known manner whereafter sheath 18 is formed around inner core 16 in a second injection molding process.

Glove 10 has sewn thereon a strap retainer sleeve 28 extending across both the palm of the glove and around the base of the thumb. Retainer sleeves 28 slidingly secure a palm strap 32 and a thumb strap 34 to the glove. Straps 32 and 34 are looped through a wire loop or buckle 40, the straps being sewn, tacked or otherwise fastened to each other and connector bar portion 38 of the buckle to position and tension it relative to the glove, and to transmit force applied to the buckle to the palm/wrist and base thumb area of the glove. Straps 32,34 fasten the buckle 40 in place on or immediately adjacent the apex of the V of the thumb and forefinger of the glove. Specifically, straps 32 and 34 diverge around the connector bar portion 38 and are sewn together below the bar and to the glove above the bar to define a loop or pocket within which connector bar portion 38 is contained. In this manner, the buckle 40 is essentially maintained in position near the apex of the V between thumb and forefinger with strap tension in two directions. Although not absolutely rigid with respect to the glove, buckle 40 is held tightly enough to clearly establish a preferred swing angle for the ski pole relative to the glove.

Straps 32,34 are preferably made of heavy nylon webbing, although other materials can be used. The width of the straps at the buckle are preferably approximately equal to the length of connector bar 38 to prevent sideways shifting of buckle 40 relative to the straps. Buckle 40 is fastened to the glove by straps 32,34 such that the forward or lock bar portion 36 of buckle 40 extends partway between the thumb and forefinger of the glove essentially in the plane of the V defined therebetween. Lock bar portion 36 forms a part of the interlock system 14. Interlock system 14 further includes a clip 42, a thumb slide 44, a screw bolt 46, and a leaf spring 48.

Clip 42 includes a main body or bar portion **42*a* received with a friction fit in a slot 16*a* in the grip core member 16 opening in the rear face of the core member proximate the upper end of the grip, and a clip portion 42*b* defining a generally U-shaped upwardly opening channel 42*c* designed to snappingly receive the buckle lock bar portion 36**.

Slide 44 is mounted for reciprocal movement between locked and unlocked positions in an upwardly opening groove or slot **16*b* provided in the top end 16*c* of the grip core member. Groove 16*b* extends from the front to the rear of the grip core member and has a width slightly exceeding the width of slide 44 so as to allow the slide 44 to move back and forth within the confines of the groove. The rearward end of slide 44 includes a locking tab portion 44*a* designed to move into locking relationship with respect to the lock bar portion 36 positioned within the clip so as to cover the opening in the clip and preclude inadvertent displacement of the lock bar from the clip. When the slide 44 is withdrawn relative to the clip the lock bar is exposed and may be withdrawn from the clip with suitable relative twisting movement between the lock bar and the clip. Slide 44 further includes an elongated upwardly opening slot 44*b* and a further elongated slot 44*c* positioned within slot 44*b* and extending between the bottom of slot 44*b* and the bottom of the slide. Slot 44*b* has a diameter slightly exceeding the diameter of the head 46*a* of the screw bolt 46 and slot 44*c* has a width slightly exceeding the diameter of the shaft 46*b* of the screw bolt 46**.

Figure 11:
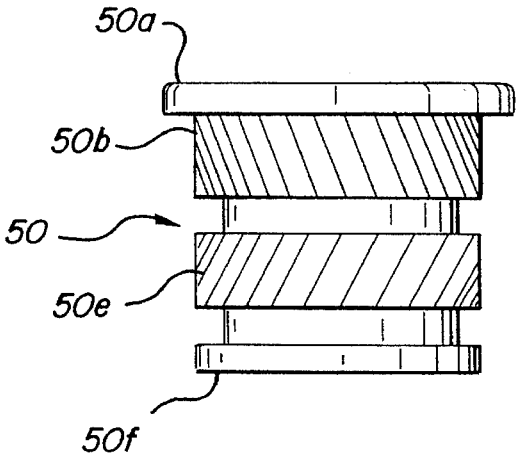
FIG. 11 is a detail view of a nut element employed in the invention ski pole assembly.

Screw bolt 46 is positioned with its head **46*a* within slot 44*b* and with its shaft 46*b* extending downwardly through slot 44*c*, through a bore 16*c* in the grip core member, and through a bore 42*d* in clip body portion 42*a* to position its lower threaded end 46*c* within a bore 16*d* in the clip core member. Bore 16*d* opens at its lower end in a central bore 16*e* which extends downwardly through the core member and opens at its lower end in the lower end of the core member. A nut element 50 is fixedly positioned within the bore 16*d* and threadably engages the lower end 46*c* of screw bolt 46. Nut element 50 is seen in detail in FIG. 11 and includes a head 50*a*, an annular portion 50*b* having teeth 50*c* skewed in one direction, an annular portion 50*d* having teeth 50*e* skewed in the opposite direction, and a lip portion 50*f*. Nut element 50 may comprise, for example, an element available from Heli-Coil Co. of Danbury, Conn. under the designation "Dodge Insert." Nut element 50 is positioned in bore 16*d* in an inverted disposition relative to the disposition illustrated in FIG. 11**.

Leaf spring 48 is positioned in groove **16*b* in underlying relation to slide 44 and includes a central bore 48*a* passing the shaft portion 46*b* of screw bolt 46. Spring 48 acts to constantly bias the slide upwardly into engagement with the underface 46*d* of the screw bolt head 46*a*. As the slide is moved backwardly and forwardly between its locked and unlocked positions relative to the clip, the screw head 46*a* coacts with a first pair of detents 44*d* and a second pair of detents 44*e* to define detented locked and unlocked positions for the slide. Detent pairs 44*d* and 44*e* are defined as cutout portions along opposite sides of slot 44*c* in the annular shoulder surface 44*f* between slots 44*b* and 44*c*. Leaf spring 48** acts to ensure that the head of the screw bolt is firmly positioned in the respective detent pair in either the locked or unlocked position of the slide and yields downwardly to allow the slide to move downwardly as it moves between its detented positions.

Figure 4:
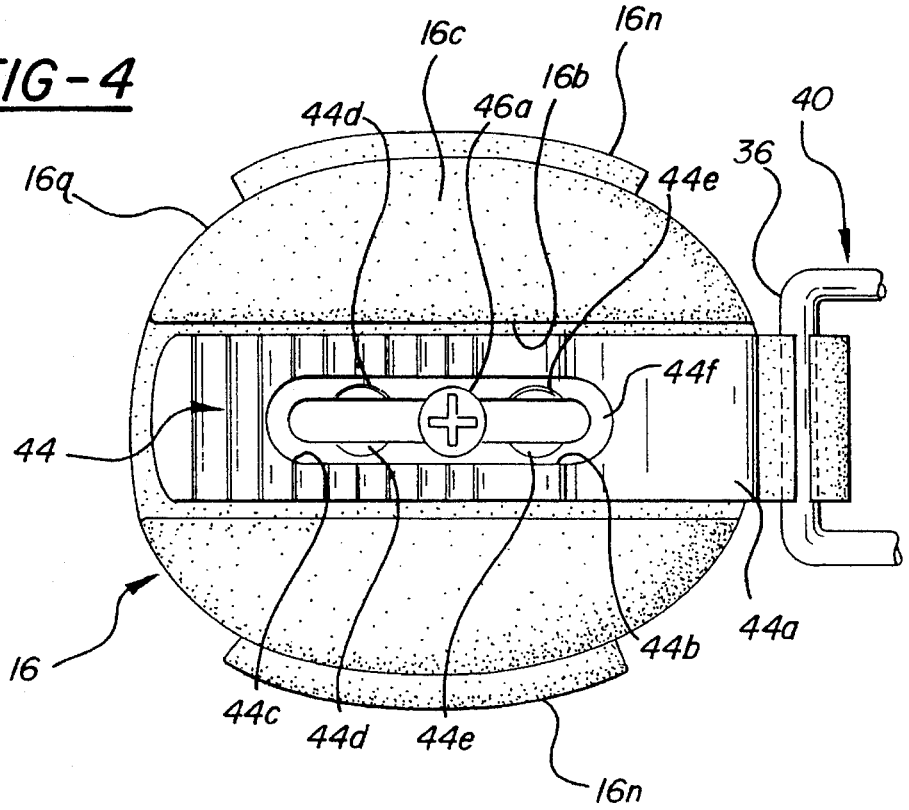
FIG. 4 is a top view of the invention ski pole grip.
Figure 5:
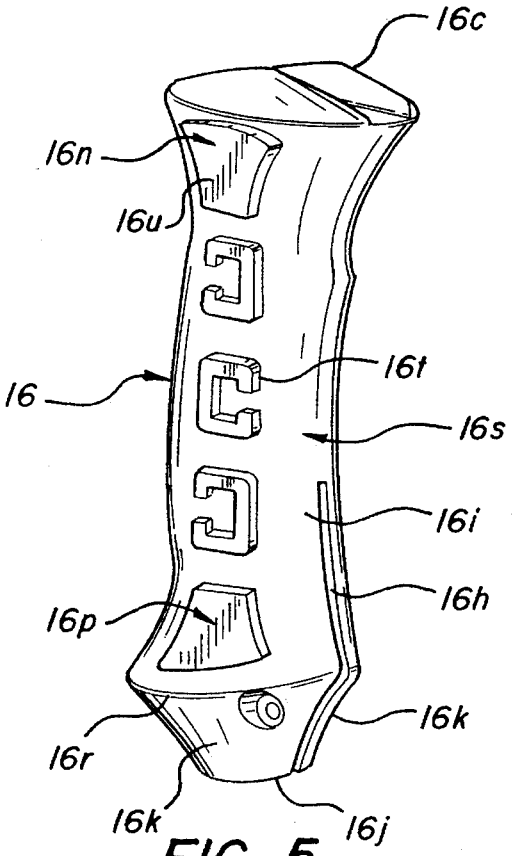
FIG. 5 is a perspective view of a core member employed in the invention ski pole grip.
Figure 6:
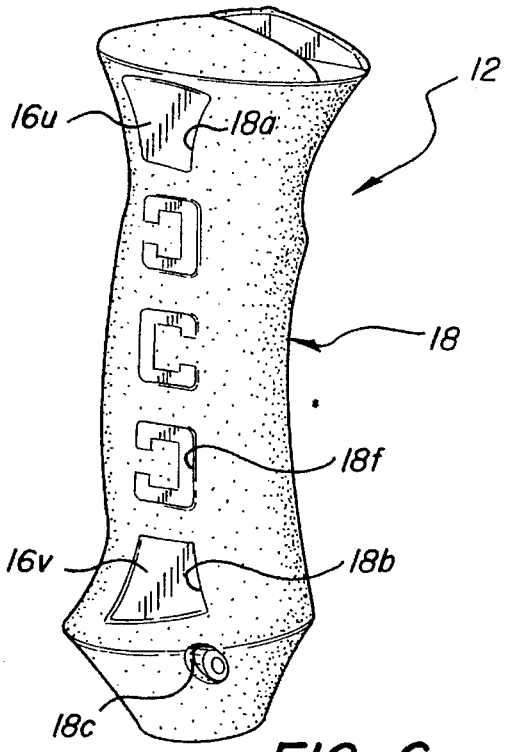
FIG. 6 is a perspective view of the invention ski pole grip with the core member covered by a sheath.
Figure 7:
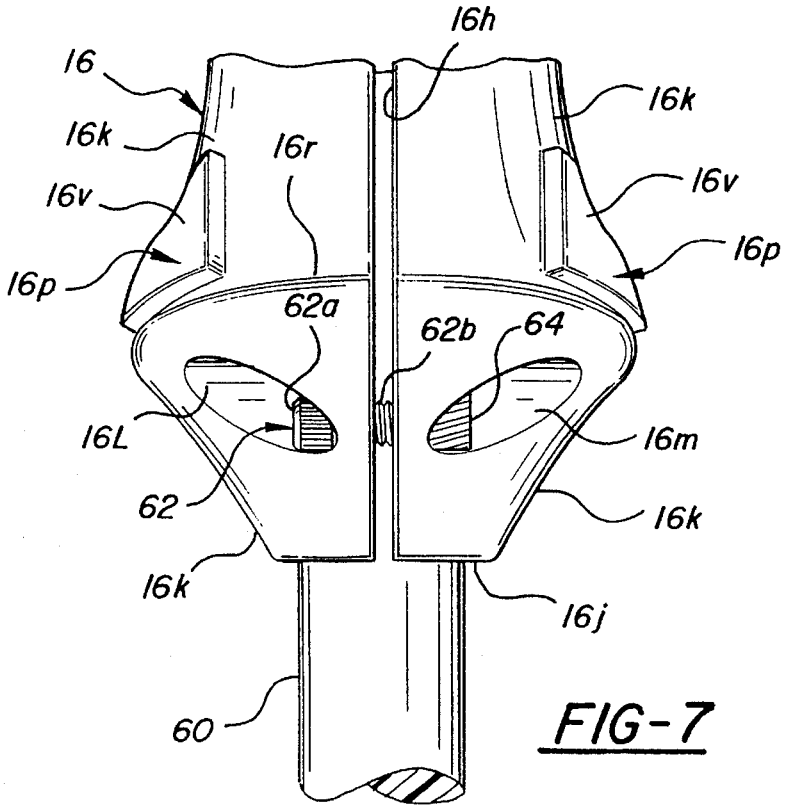
FIG. 7 is a fragmentary view of the lower end of the core member of the invention ski pole grip.
Figure 8:
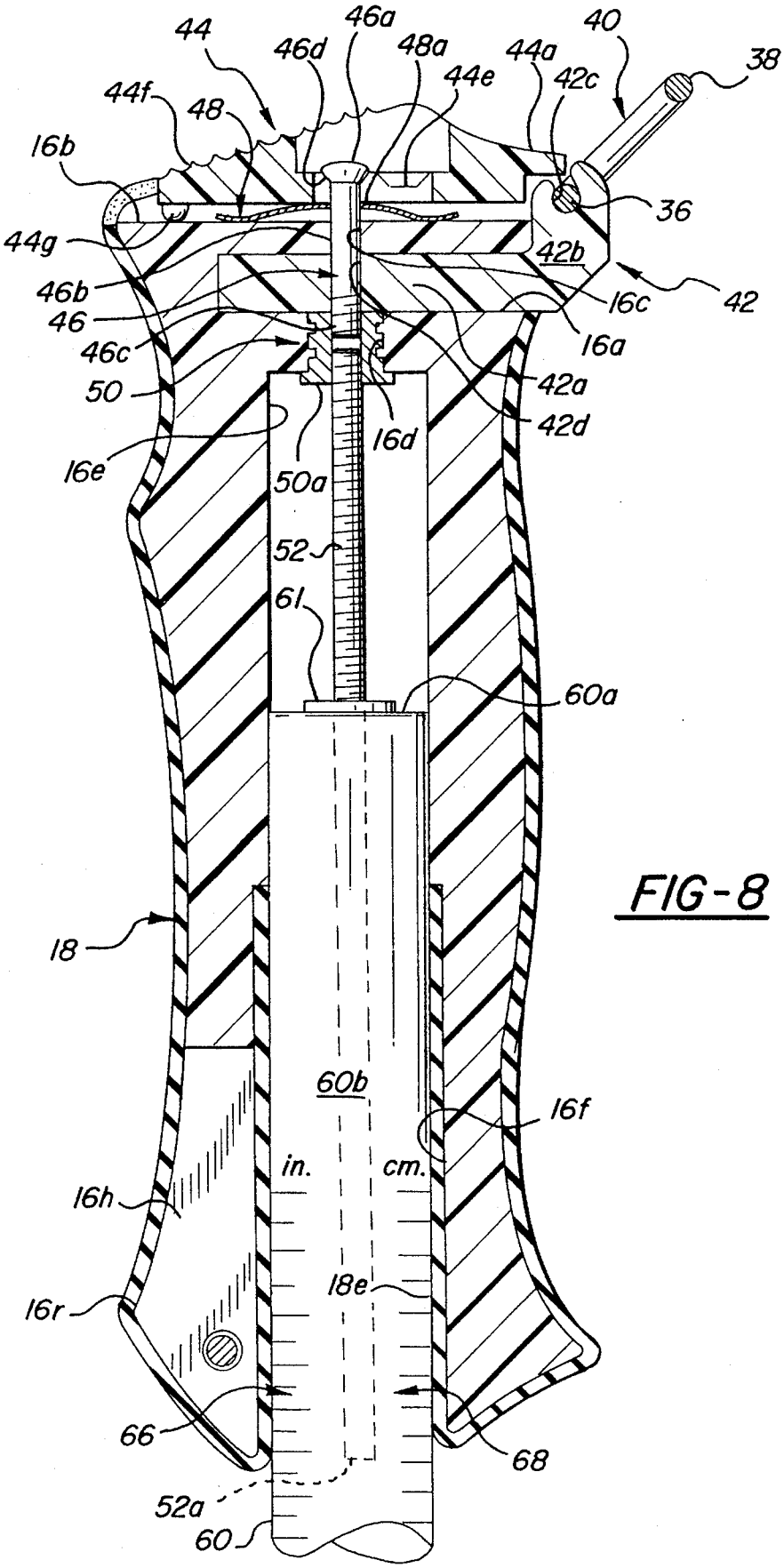
FIG. 8 is a fragmentary cross-sectional view of the invention ski pole grip.
Figure 9:
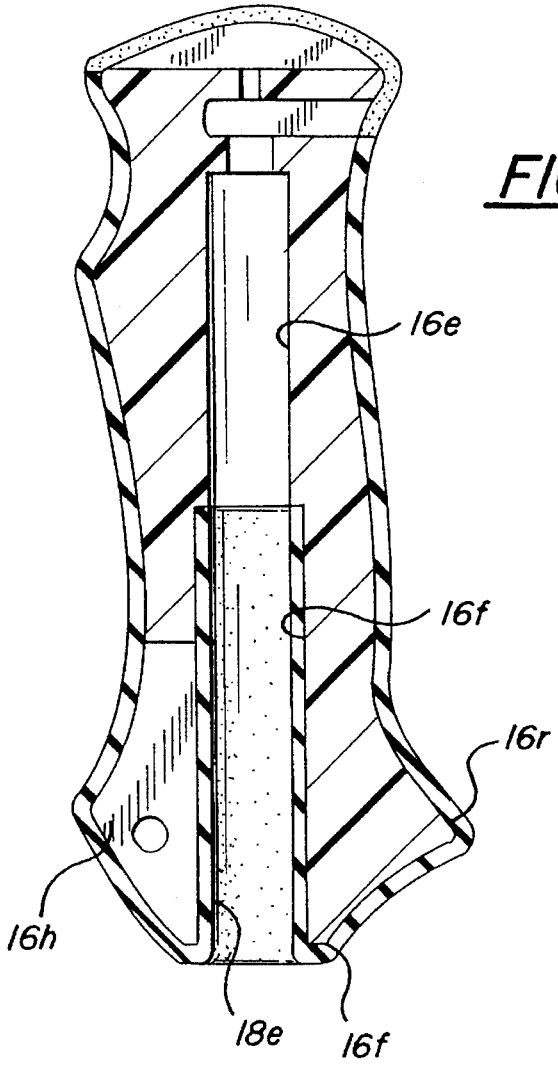
FIG. 9 is a cross-sectional view of the invention ski pole grip with the shaft of the ski pole and the locking mechanism omitted for purposes of clarity.
Figure 10:
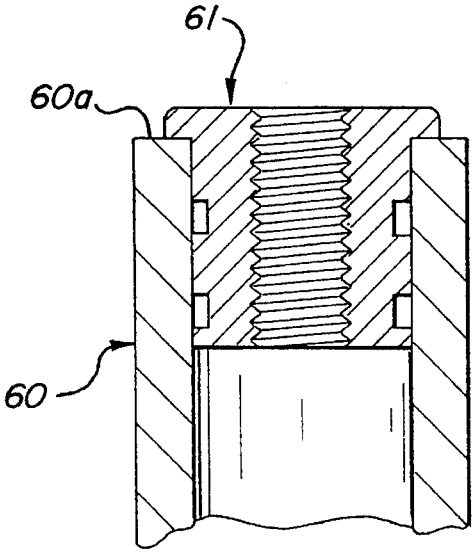
FIG. 10 is a detail view of the upper end of the ski pole shaft.

The slide is shown in its unlocked position in FIG. 3, in its locked position in FIG. 8, and in an intermediate position in FIG. 4. Slide 44 preferably includes serrations or ridges **44*f* on the top face of the slide to facilitate grasping of the slide by the gloved thumb of a user and thereby facilitate movement of the slide between its locked and unlocked positions. Slide 44 further includes a protrusion 44*g* on the bottom of the slide proximate the forward end of the slide to guide the forward end of the slide in its sliding movement within groove 16*b***.

It will be understood that the skier inserts the buckle lock bar portion 36 into the channel **42*c* of the clip with the slide in the unlocked position and thereafter slides the slide rearwardly to the locked position in which the locking tab 44*a* of the slide precludes inadvertent displacement of the lock bar portion 36** from the clip. Because the slide moves at approximately right angles to the release direction of the glove side interlock structure from the pole side interlock structure, forces tending to separate the glove side interlock structure from the pole side interlock structure when the slide is in the locked position actually strengthen the locked position of the slide since such release forces are operative in the same direction as the spring bias which tends to hold the slide in one or the other of the locked and unlocked positions in cooperation with the detent system.

Core member 16, in addition to forming the slot **16*a*, groove 16*b*, bore 16*c* and bore 16*d* in the upper end of the core member to accommodate the elements of the interlock system 14, and the central blind bore 16*e* opening at its lower end in the lower end of the core member, further defines a lower counter bore portion 16*f* extending from a point approximately midway of the length of the core member to the lower end of the core member. Counterbore 16***f* may have a diameter, for example, exceeding the diameter of bore 16*e* by 0.004 inches. A bolt element 52 is threadably received at its upper end in the lower end of nut element 50 and extends downwardly in bore 16*e*, in spaced relation to the wall surface of the bore, to position its lower end 52*a* proximate the lower end of the grip.

Core member 16 further defines a slit 16*h* opening in the bore 16*f*, in the lower outer side surface 16*i* of the core member, and in the lower end 16*j* of the core member to define a pair of core member portions 16*k* on opposite sides of the slit 16*h*. Core member 16 further defines a pair of aligned cross bores 16*l* and 16*m* extending through the portions 16*k* on either side of the slit 16*h* at a location proximate the lower end of the core member.

Core member 16 further includes a pair of raised pads 16*n* on opposite sides of the core member proximate the upper end of the core member, a pair of raised pads 16*p* on opposite sides of the core member proximate the lower end of the core member but above bores 16*l* and 16*m*, and a vertically spaced series of protrusions 16*t* on each side of the grip extending between a respective upper pad 16*n* and a respective lower pad 16*p*. Core member 16 further defines an annular ridge 16*q* extending around the upper end of the core member and a further annular ridge 16*r* extending around the lower end of the core member at a location between lower pads 16*p* and cross bores 16*l* and 16*m*. It will be understood that ridges 16*q* and 16*r* delimit and define the area 16*s* of the core member constituting the grasp area about which the gloved fingers of the user are wrapped.

A ski pole shaft 60 of generally circular tubular cross section is sized to be inserted upwardly into bore 16*e* and has an outer diameter generally corresponding to the diameter of bore 16*e* so that the upper end 60*a* of the ski pole shaft may be received with a friction sliding fit in the bore 16*e* but with the intermediate portion 60*b* of the shaft proximate counterbore 16*f* defining an annular clearance with the core member of approximately 0.002 inches. It will be understood that the shaft may be slid upwardly and downwardly in bore 16*e* to selectively adjust the overall length of the pole assembly. A nut element 61, corresponding generally to the nut element 50, is fixedly positioned in the upper end of the shaft 60 with its head portion seated on the annular upper end of the shaft. Nut element 61 is threaded onto the lower end 52*a* of bolt 52 to thread the shaft 60 upwardly along the bolt 52 with the pole moving progressively upwardly within bore 16*e* to a desired position of longitudinal adjustment relative to the grip such, for example, as the position of adjustment seen in FIG. 8. Inch gradations 66 and centimeter gradations 68 may be provided on shaft 60 to indicate the overall length of the pole assembly in each adjusted position of grip 12 relative to shaft 60.

Sheath 18 may be formed for example of a Santoprene® or Kratone® material and totally surrounds the core member 16 with the exception of upper windows 18*a* sized to receive pads 16*n*, lower windows 18*b* sized to receive pads 16*p*, and further openings 18*c* in alignment with bores 16*l* and 16*m*. The upper end of the sheath 18 is also selectively cut away to expose the groove 16*b* in the upper end of the core member so as to not interfere with the sliding movement of slide 44 within groove 16*b*. Sheath 18 also extends upwardly within counterbore 16*f* to form an annular liner portion 18*e* having a wall thickness equal to the differential in the radius of core member bore portion 16*e* and core member counterbore portion 16*g* so that the inner surface of the annular sheath portion 18*e* is flush with the inner surface of bore 16*e* and so that sheath portion 18*e* firmly and slidably engages the intermediate portion 60*b* of the ski pole as the ski pole is inserted upwardly into the grip. Note that sheath 18 is not cut away in the region of slit 16*h* but rather covers the slit so that the slit is not visible in the final composite grip structure.

Sheath 18 further includes window portions 18*f* receiving core member protrusions 16*t*. It will be understood that pads 16*n* and 16*p* and protrusions 16*t* are raised above the general surface of core member 16 by a distance corresponding to the thickness of the sheath 18 so that the outer surfaces 16*u* of pads 16*n* provide low friction surface areas proximate the upper end of the grip on opposite sides of the grip and the outer surfaces 16*v* of pads 16*p* provide low friction surface areas proximate the lower end of the grip on opposite sides of the grip. Protrusion 16*t* coact with the adjacent portions of the sheath to interlock the sheath with respect to the core member and preclude undesirable shifting of the sheath relative to the core member in the intermediate portion of the sheath between upper pad 16*n* and lower pads 16*p*.

An Allen head fastener 62 is positioned in aligned bores 16*l* and 16*m* with its head 62*a* positioned in bore 16*l* and its threaded shaft portion 62*b* extending through bore 16*l* and through bore 16*m* for threaded engagement with a nut element 64 fixedly positioned in bore 16*m* so that threaded movement of fastener 62 in a tightening direction has the effect of closing up core member portions 16*k* to close up the slit 16*h*. Nut element 64 may be similar to nut elements 50 and 61.

In the use of the invention ski grip and ski glove assembly, with the glove of the user firmly grasping the ski grip, the low friction surface areas 16*u* provided by the exposed surfaces of the upper pads 16*n* of the core member directly underlie the thumb of the glove and the midportion of the index finger of the glove, and the low friction surfaces 16*v* defined by the exposed surfaces of pads 16*b* of the core member interface with the lower palm of the glove and with the inner face of the tip of the small finger of the glove. When it is desired to execute a "pole touch," the grasp of the glove around the grip is loosened to allow the ski pole to swing outwardly about the axis defined by the lock bar 36. As the pole swings outwardly, the lower surface areas 16*v* facilitate the separation of the lower portion of the grip from the grasp of the glove and the upper surface area 16*u* serve as low friction pivot surfaces about which the pad may swing. Once the "pole touch" has been completed and the pole is allowed to swing back into the position of FIG. 2, the glove may again grasp the high friction surface provided by the sheath 80 with a majority of the grip serving to provide a firm positive gripping interface as between the glove and the grip.

It will be understood that the shaft 60 is held in a desired position of longitudinal adjustment within the bore 16*e* of the grip by the combined locking action provided by the clamping action of core member portions 16*k* about the shaft in response to tightening of fastener member 62 in coaction with trapped nut 64; the high friction grasping action of sheath annular portion 18*e* about shaft 60; and the positive wedge lock provided by the threaded interengagement of bolt 52 and nut 61.

The overall length of the pole assembly may be readily adjusted to suit various size users by simply loosening the fastener 62, sliding the grip upwardly or downwardly on the shaft to the desired new adjusted position, and retightening the fastener 62 to again clamp the core member portions 16*k* about the shaft and fixedly lock the core member on the shaft in its adjusted position with the locking action again occurring as a combination of the soft, high friction grasping action of the sheath annular portion 18*e* around the shafts; the wedging interlock of the threads of bolt 52 and nut 61, and the clamping action of core member portions 16*k* in response to tightening of fastener 62.

The invention will be seen to provide an improved ski grip and ski glove assembly wherein the glove may normally firmly grasp the ski grip, but wherein the ski grip may be readily released from the glove, and may swing with a low friction action outwardly about the axis of the lock bar to achieve a "pole touch." The invention further provides a ski pole assembly which may be readily adjusted to accommodate various size skiers and which, by virtue of the positive wedge lock of the coacting bolt and nut in coaction with the firm frictional interlock between the annular portion 18*e* of the sheath and the shaft and the tightening action of the fastener 62, will fixedly maintain any selected position of relative adjustment of the grip on the shaft.

Whereas a preferred embodiment of the invention has been illustrated and described in detail, it will be apparent that various changes may be made in the disclosed embodiment without departing from the scope or spirit of the invention.

We claim:

1. A ski pole assembly comprising a shaft and a grip adapted to be fitted on the upper end of the shaft characterized in that the grip includes an inner core member formed of a relatively hard low friction material and including a downwardly opening bore receiving the upper end of the shaft and allowing the shaft to be adjustably positioned in the bore to selectively vary the overall length of the ski pole, the lower end of the bore as it exits the core member is oversized with respect to the shaft diameter, and the grip further includes an outer sheath of soft, relatively high friction material surrounding the lower end of the core member and including an annular liner portion extending upwardly into said bore and having an inner diameter approximating the diameter of the shaft so that the liner tightly embraces the shaft as the shaft enters the bore.

2. A ski pole assembly according to claim 1 wherein said ski pole assembly further includes a bolt extending downwardly in said bore and a nut positioned on the upper end of the shaft for coaction with the bolt to adjust the longitudinal position of the shaft in the bore and thereby vary the overall length of the ski pole assembly.

3. A ski pole grip adapted to be fitted on the upper end of a ski pole shaft to form a ski pole assembly characterized in that the grip includes a grip member defining a central downwardly opening bore adapted to receive the upper end of the shaft and allow the shaft to be adjustably positioned in the bore to selectively vary the overall length of the ski pole assembly, a slit is provided in the lower end of the grip member opening, in the lower end of the grip member, and in the lower side surface of the grip member, and tightening means are provided to clamp the portions of the grip member on opposite sides of the slit against the shaft to maintain the shaft in its adjusted position within the bore, wherein said tightening means comprises fastener means passing through aligned cross bores in the grip member portions, wherein said grip member comprises a core member and wherein said grip further includes a sheath surrounding the core member, covering the opening of the slit in the side surface of the core member and in the lower end of the core member, and including an opening to pass the shaft and further openings in alignment with said cross bores to allow access to the fastener means.

4. A ski pole grip comprising:

an inner core member formed of a hard low friction material, the core member having upper and lower ends and including raised pads proximate the upper end of the core member; and an outer sheath member formed of a soft, high friction material surrounding the core member and including windows receiving said pads so that the exposed surfaces of the pads comprise a low friction surface area proximate the upper end of the grip, wherein said inner core member includes further raised pads proximate the lower end of the core member and said sheath member includes further windows receiving said further pads so that the exposed surfaces of the further pads comprise a further low friction surface area proximate the lower end of the grip.

5. A ski pole grip according to claim 4 wherein said raised pads proximate the upper end of said core member are located on opposite sides of said upper end of the ski pole grip.

6. A ski pole grip according to claim 4 wherein said further raised pads proximate the lower end of said core member are located on opposite sides of said lower end of the ski pole grip.

7. A ski pole grip adapted to be fitted over the upper end of a ski pole shaft to form a ski pole assembly characterized in that the grip is adjustable longitudinally with respect to the shaft to vary the overall length of the ski pole assembly and the grip includes locking means which are operative to lock the grip on the shaft in any position of longitudinal adjustment of the grip on the shaft, the shaft is received in a blind bore in the grip opening at the bottom of the grip, and said locking means includes a slit in the lower end of the grip opening, in the bore, in the lower end of the grip, and in one side face of the grip to define two grip portions at opposite sides of the slit and fastener means engaging said grip portions and operative when actuated to clamp the grip portions on the shaft to lock the grip in any position of longitudinal adjustment on the shaft, said grip includes a core formed of a hard low friction material and defining said bore and said locking means further includes a liner of soft high friction material positioned in the lower end of said bore and coacting with said slit and said fastener means to firmly grasp the shaft in any position of longitudinal adjustment on the shaft.

8. A ski pole grip according to claim 7 wherein said soft high friction material extends out of said bore and substantially covers said core to form a soft, high friction surface on said core to facilitate grasping of the grip by the skier.

* * * * *